United States Patent [19]

Akesaka

[11] Patent Number: 4,662,606

[45] Date of Patent: May 5, 1987

[54] PIPE PROPELLING DEVICE

[75] Inventor: Toshio Akesaka, Yokohama, Japan

[73] Assignee: Kabushiki Kaisha Iseki Kaihatsu Koki, Tokyo, Japan

[21] Appl. No.: 706,340

[22] Filed: Feb. 27, 1985

[30] Foreign Application Priority Data

Apr. 16, 1984 [JP] Japan ..... 59-74894

[51] Int. Cl.[4] ..... E21B 19/00

[52] U.S. Cl. ..... 254/29 R

[58] Field of Search ..... 91/520; 92/52, 63; 254/29 R, 93 R, 30

[56] References Cited

U.S. PATENT DOCUMENTS

| | | | |
|---|---|---|---|
| 3,145,964 | 8/1964 | Groetschel | 254/93 R |
| 3,795,176 | 3/1974 | Lada | 91/520 |
| 4,082,248 | 4/1978 | Hinrichsen | 254/29 R |
| 4,159,819 | 7/1979 | Bargel et al. | 254/29 R |

FOREIGN PATENT DOCUMENTS

| | | | |
|---|---|---|---|
| 257729 | 10/1970 | U.S.S.R. | 254/29 R |

*Primary Examiner*—Robert C. Watson

*Attorney, Agent, or Firm*—Kane, Dalsimer, Kane, Sullivan and Kurucz

[57] ABSTRACT

A pipe propelling device comprises two sets of jack assemblies spaced from each other and arranged in the direction of propelling the pipe in a vertical shaft having a reacting shaft wall so that the small diameter pipe such as water supply and drainage pipes, gas pipes and cable laying pipes can be propelled from the interior to the exterior of the vertical shaft by the extension of two sets of the jack assemblies. To reduce the dimension of the vertical shaft due to propel the pipe, eliminate the interposition of a strut in propelling the pipe and secure an operative space in the vertical shaft, the jack assemblies comprise a plurality of first stage jacks connected to the reacting shaft wall and at least one second stage jack, a cylinder of the second stage jack being connected to cylinders of the first stage jacks.

4 Claims, 4 Drawing Figures

PIPE PROPELLING DEVICE

BACKGROUND OF THE INVENTION

1. Field of the Invention

This invention relates to a device for propelling a pipe from a vertical shaft, and more particularly, to a device for exerting propelling power to small bore pipes such as water supply and drainage pipes, gas pipes and cable laying pipes to force them into the ground from the vertical shaft.

2. Description of the Prior Art

Conventionally, a plurality of hydraulic jacks are used for a device for propelling pipes from vertical shafts. The respective hydraulic jacks forming a propelling device are provided to contact on one end a reacting shaft wall of the vertical shaft and on the other end the end of the pipe. The pipe in the vertical shaft is forced into the ground by the operation of the hydraulic jack.

Now, when one operative stroke of the hydraulic jack is made equal to or longer than the length of the pipe, the pipe can be forced from the interior to the exterior of the vertical shaft by only one operation of the hydraulic jack. On the other hand, since the length of the hydraulic jack has to be equal to or longer than that of the pipe, the size of the shaft, i.e., the distance between the reacting shaft wall and the shaft wall surface opposed thereto must be at least 2 times the length of the pipe.

Thus, a problem is encountered in a lot of labor and cost needed for forming the vertical shaft.

On the other hand, when one operative stroke of the hydraulic jack is shorter than the length of the pipe, the size of the vertical shaft can be made less than that in the case of said jack having the operative stroke equal to or longer than the length of the pipe. In this case, however, the pipe cannot be forced into the ground unless a strut is interposed between the pipe and the hydraulic jack. That is, the pipe must be propelled through said strut by extending a rod of the hydraulic jack to force a portion of the pipe into the ground and then withdraw the rod so that said strut is disposed between the pipe end and the rod end of each hydraulic jack to operate again the hydraulic jack. Depending upon the size of said operative stroke must be further reciprocated the rod and added another strut to force the pipe into the ground.

Thus, though the labor and cost needed for forming the vertical shaft can be reduced, troublesome operations such as arrangement of a plurality of struts are added conversely. The efficiency of operation is then obliged to be degraded.

Also, a plurality of said conventional hydraulic jacks are arranged in the form of a box spaced from each other in the circumferential direction of the pipe between the pipe to be propelled and the reacting shaft wall. Thus, measuring instruments such as a propelling error measuring instrument applying laser to the measurement cannot be installed and operated on the pipe axis between the jacks so that troubles take place in measuring the propelling direction of the pipes sequentially forced into the ground to present problems that the operative space in the vertical shaft is narrowed or the vertical shaft must be expanded.

SUMMARY OF THE INVENTION

Accordingly, an object of the present invention is to overcome said conventional problems. That is, the present invention aims to enable pipes to be propelled from a small-dimensioned vertical shaft without interposing any struts while providing a sufficient operative space within the vertical shaft.

A pipe propelling device according to the present invention comprises fundamentally two sets of jack assemblies supported spaced from each other in the vertical shaft and extending laterally of said vertical shaft, each jack assembly comprising a plurality of first stage jacks having a rod end contacting said reacting shaft wall and at least one second stage jack having cylinders connected to the respective cylinders of the first stage jacks and directing the rod end forward in the direction of propelling said pipe.

According to the present invention, the total length of the jack assembly prior to the propulsion of pipe can be minimized while the operative stroke of the jack assembly can be made longer than the length of the pipe by extending operatively said first and second stage jacks.

Accordingly, the size of the vertical shaft can be minimized and further the pipe can be forced entirely into the ground by one operation of the jack assembly without interposing the strut, thereby the efficiency of operation can be remarkably improved.

Further, the present device is made of two sets of jack assemblies spaced from each other, and portions at which the pipes to be propelled against the respective jack assemblies are limited only to the rod end of the second stage jack so that the jacks are not arranged in the form of a box like prior ones. Thus, an instrument for measuring the direction of propelling the pipe forced into the ground can be disposed easily between the jack assemblies or rods.

Also, a gap between the rod end of the second stage jack and the reacting shaft wall can be lessened by locating the front end of said first stage jack in front of the rod end of said second stage jack when all said jacks are under the contracted condition. Consequently, the pipe prior to the propulsion can be arranged closer toward said reacting shaft wall and thus the lateral length of the vertical shaft can be set shorter.

Further, only one first stage jack can be formed with a port connected directly to a pressurized liquid supply source by interconnecting liquid chambers for extruding and returning the first stage jack and liquid chambers for extruding and returning the second stage jack respectively through pressurized liquid pipe paths. Thus, compared with the case in which ports communicating to the pressurized liquid supply source are provided in the respective jacks, the number of pipings can be lessened, and damages due to mutual friction of the pipings can be prevented. Since the cylinders of the first and second stage jacks are interconnected, the first and second stage jack cylinders are moved always integrally with each other. Thereby, no friction takes place between the pipings for these cylinders.

Further, by disposing a push ring connected to the second stage jack to be pivoted about said jack can be adjusted the moving speed of both jacks in the contracting operation of the second stage jack forming a part of each assembly to be approximately equal to each other.

The other objects and features of the present invention will become apparent from the following description of a preferred embodiment of the invention with reference to the accompanying drawings.

DESCRIPTION OF THE PREFERRED EMBODIMENT

Figure 1:
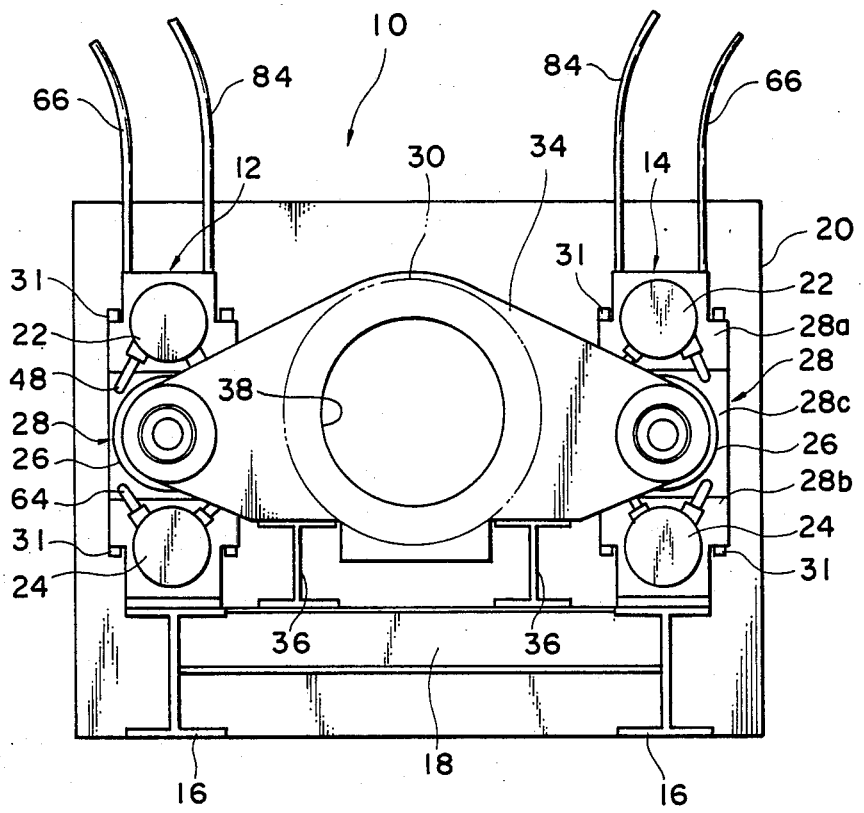
FIG. 1 is a front view showing a pipe propelling device according to the present invention.

As shown in FIG. 1, a pipe propelling device 10 according to the present invention comprises two sets of jack assemblies 12, 14 spaced from each other in a vertical shaft and extending laterally (in the direction of propelling the pipe) of the vertical shaft. Both jack assemblies are slidably mounted on a pair of frames 16 disposed on the bottom of the vertical shaft and extending laterally. The frames 16 are made of H-type steel and interconnected by a plurality of connecting members 18 made of H-type steel arranged longitudinally spaced from each other. Also, the frames 16 are on the rear ends fixed by bolts to a box-like reacting support 20 fixed to the reacting shaft wall of the vertical shaft (see FIGS. 2 and 3).

Figure 2:
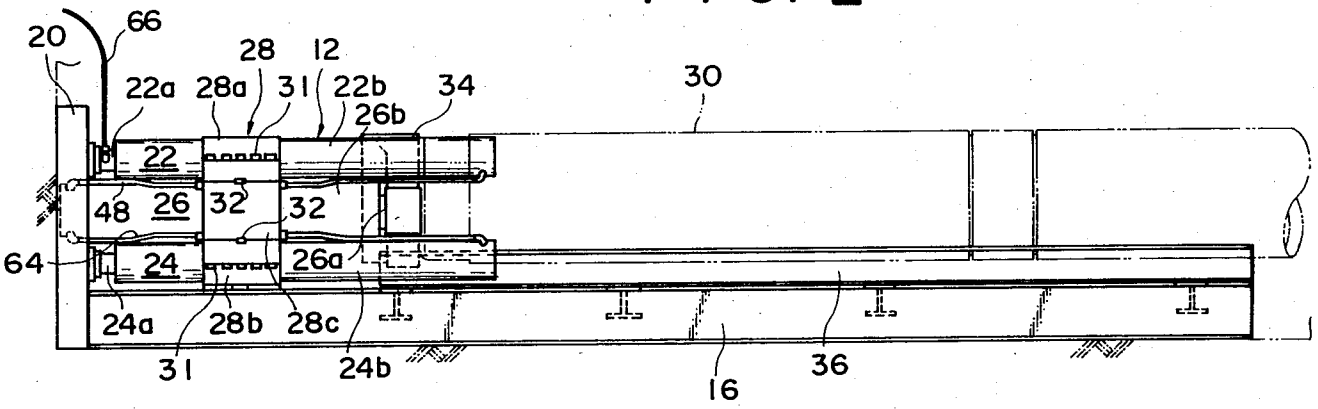
FIG. 2 is a left side view showing the pipe propelling device under the completely contracted condition.
Figure 3:
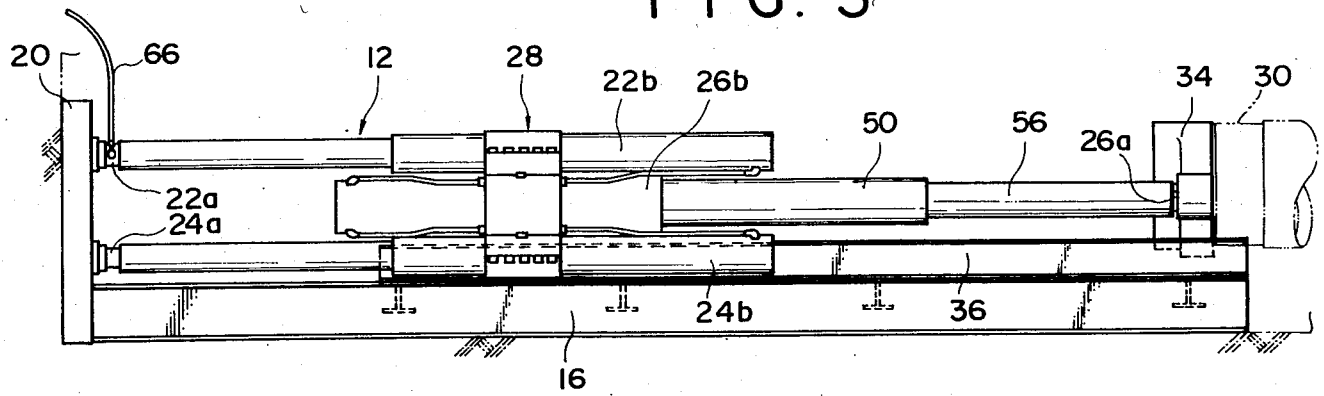
FIG. 3 is a left side view showing the pipe propelling device under the extended condition.

As shown in FIGS. 1 to 3, each jack assembly comprises a pair of first stage jacks 22, 24 arranged spaced from each other vertically and a second stage jack 26 disposed between the first stage jacks, said first and second stage jacks being interconnected by connecting means 28. The first stage jacks 22, 24 have the same operative stroke and total length.

The first stage jacks 22, 24 have respectively the rod ends 22*a*, 24*a* connected to the reacting support 20, and a rod end 26*a* of the second stage jack 26 are directed forward in the direction of propulsion. Further, a cylinder 26*b* of the second stage jack extends through the reacting support 20 from the front portion to the rear portion. Thus, the front ends of the cylinders 22*b*, 24*b* of the first stage jacks are arranged to be located in front of the rod end 26*a* of the second stage jack so that a gap between said reacting shaft wall and the rod end 26*a* of the second stage jack can be lessened, compared with the case of arranging said front ends reversely, provided the second stage jack 26, when subjected to extending operation, needs to be able to extend the rod end 26*a* forward more than the front ends of cylinders 22*b*, 24*b* of the first stage jacks. By such an arrangement, a pipe 30 disposed in front of the rod end 26*a* to be propelled can be located nearer said reacting shaft wall, and thus the lateral length of the vertical shaft can be set small. In consideration of this point of view, the total length of the second stage jack under the completely contracted condition is preferably shorter than that of the first stage jack under the completely contracted condition. Further, by providing the multiple stage jack like the embodiment shown in the drawings, the second stage jack 26 can be obtained the short total length under the contracted condition, but the large operative stroke.

The connecting means 28 comprises steel blocks 28*a*, 28*b* in which the cylinders 22*b*, 24*b* of the first stage jacks 22, 24 fit firmly and a steel block 28*c* in which the cylinder 26*b* of the second stage jack 26 fits firmly. The blocks 28*a*, 28*c* and 28*b*, 28*c* are respectively fixed to each other by a plurality of bolts 31, and further between the respective blocks are arranged keys 32 to prevent positively slippage between the first and second stage jacks.

Further, a plurality of pairs other than one pair of the first stage jacks in each jack assembly may be provided and the quantity of the second stage jack may be at least one, provided it is preferable that to give stable thrust to the pipe 30 and propel the pipe 30 efficiently, the respective first stage jacks have the equal capacity, i.e., produced thrust and further the sum of these capacities is equal to the capacity of the second stage jack or to the sum of these capacities when the second stage jacks are plural.

To the second stage jacks in both jack assemblies is connected a push ring 34 for transmitting thrust to the pipe 30. This push ring 34 is arranged on the connecting member 18 of the frame 16 and mounted slidably on a pair of supports 36 extending laterally. The longitudinal dimension of the push ring is maximized in the intermediate position between two sets of jack assemblies 12, 14 and decreased gradually from said intermediate position toward the respective jack assemblies. Also, the push ring 34 is provided with a hole 38 for passing laser beam or the like to measure the direction of propelling the pipe 30.

Figure 4:
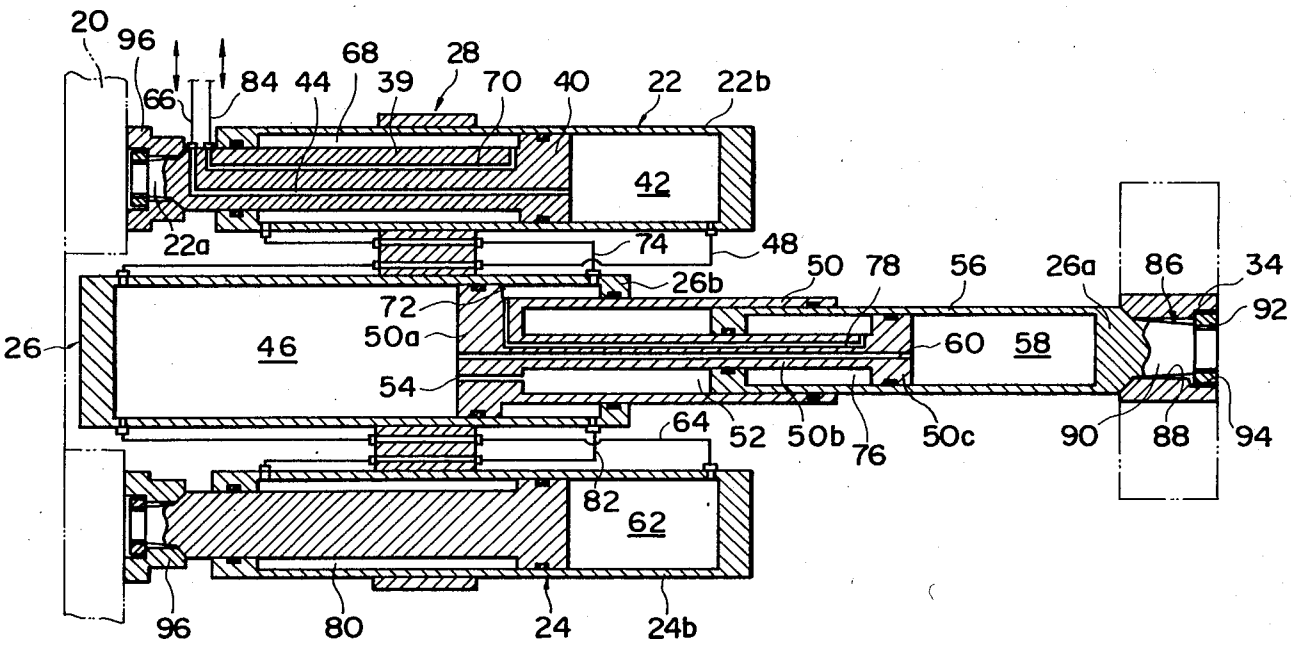
FIG. 4 is a longitudinal sectional view of the pipe propelling device as viewed from the side, showing schematically a pressurized liquid pipe path.

For the extruding and returning operations of the respective jacks are provided ports communicating to liquid chambers for the extrusion and return in the cylinders. Though pressurized liquid supply pipes may be connected to the respective ports, it is preferable, as shown in FIG. 4, that the extruding and returning liquid chambers of the first stage jacks 22, 24 are connected respectively to the extruding and returning liquid chambers of the second stage jack 26 through pressurized liquid pipe paths.

Extruding and returning ports corresponding to holes for supplying pressurized liquid are provided in the rod ends 22*a* of the upper first stage jacks.

The extruding pressurized liquid pipe path is made of a path 44 communicating to an extruding liquid chamber 42 in front of a piston 40 from said extruding port through a rod 39 and the piston 40 of the first stage jack, a conduit 48 communicating to the liquid chamber 42 and an extruding liquid chamber 46 in the inner rear portion of the cylinder 26*b* of the second stage jack, a path 54 extending from the liquid chamber 46 through a piston portion 50*a* of a first rod 50 of the second stage jack to communicate to an extruding liquid chamber 52 of the first rod 50, a path 60 extending from the liquid chamber 46 through the piston portion 50*a* of the first rod, a rod portion 50*b* communicating to the piston portion and a piston portion 50*c* communicating to the rod portion and received in a hollow portion of a second rod 56 to communicate to an extruding liquid chamber 58 in front of the piston portion 50*c* and a conduit 64 communicating to the liquid chamber 46 and an extruding liquid chamber 62 in the inner front portion of the cylinder 24*b* of the lower first stage jack. Further, referring to said capacity again, the sum of pressure receiving areas of both first stage jack pistons respectively in the extrusion and return is equal to the pressure receiving areas of the piston portions 50*a*, 50*c* and rear portion of the second rod 56 of the second stage jack.

When pressurized liquid is supplied to said extruding port through a pressurized liquid supplying conduit 66 connected to a pressurized liquid supply source (not shown), the cylinders 22*b*, 24*b*, the first rod 50 and the second rod 56 are simultaneously started to move forward in the propelling direction.

On the other hand, the returning pressurized liquid pipe path is made of a path 70 communicating to a returning liquid chamber 68 behind the piston 40 from said returning port through the rod 39 of the first stage jack, a conduit 74 communicating to the liquid chamber 68 and a returning liquid chamber 72 in the inner front portion of the cylinder 26*b* of the second stage jack, a path 78 communicating to a returning liquid chamber 76 of the second rod from the liquid chamer 72 through the piston portion 50*a* and the rod portion 50*b* of the first rod and a conduit 82 communicating to the liquid chamber 72 and a liquid chamber 80 in the inner rear portion of the cylinder 24*b* of the lower first stage jack.

When pressurized liquid is supplied to said returning port through a pressurized liquid supplying conduit 84 connected to the pressurized liquid supply source, the cylinders 22*b*, 24*b*, the first rod 50 and the second rod 56 are started to move simultaneously backward in the propelling direction.

When said first and second stage jacks are operatively extended and contracted, the connecting means 28 slides on the frame 16 with a pair of lower projecting ends of the block 28*b* contacting the frame 16, and the push ring 34 and the pipe 30 contacting the push ring on the end slide on the support 36.

Further, the extruding conduits 48, 64 and the returning conduits 74, 82 can be formed to extend respectively through the block 28*c*, a part of the connecting means 28 for said first and second stage jacks or, as shown in FIG. 4, a path extending through the block 28*c* may be provided to which said conduit communicates. In either case, since said first and second stage jacks are fixed to each other in these cylinders, each conduit is never affected by the extending and contracting operations. Also, by forming the pressurized liquid pipe path in such a manner, damages of pipings due to friction between pipings are not needed to be taken into consideration.

In the extending and contracting operations of all jacks, particularly in the returning operation of contraction, each jack may not retreat with equal speed due to the fitting condition of a packing for preventing pressurized liquid from leakage, dimensional error or the like. To avoid such a phenomenon as far as possible, the push ring 34 is preferably connected to the second stage jack 26 through a connecting portion 86 to permit pivoting about said jack.

As shown in FIG. 4, the connecting portion 86 comprises a socket 88 provided in the push ring 34 and a slip-out preventing member 92 received in the socket and fixed to a reduced diameter portion 90 of the second stage jack rod end 26*a* having the outer diameter converging forward in said propelling direction to prevent the reduced diameter portion 90 from slipping out of said socket. The reduced diameter portion 90 is formed on the front end with threads onto which is screwed the nut-like slip-out preventing member 92. Also, the slip-out preventing member 92 is received in a recess 94 communicating to the socket 88, and a slight gap is provided between the wall surface of the recess and the slip-out preventing member 92.

Accordingly, when speed difference between both second stage jacks 26 is produced when said both jacks 26 are contracted backward in the propelling direction after the pipe 30 is propelled, the push ring 34 is allowed to pivot in the reduced diameter portion 90 within the range of the gap between the socket 88 and the reduced diameter portion 90 or between the slip-out preventing member 92 and the wall surface of the recess 94. Thereby, the push ring 34 is inclined and one of the second stage jack rod ends 26*a* regulates the retreat movement of the other second stage jack rod end 26*a* so that both rod ends 26*a* will move with approximately equal speed.

Instead of above-mentioned construction, said connecting portion may be formed such that the socket 88 has the inner diameter converging forward in said propelling direction and the reduced diameter portion 90 has the constant outer diameter.

The connecting portion having such a construction may be also applied between the first stage jack rod ends 22*a*, 24*a* and a base member 96 mounted on the reacting support 20 (see FIG. 4).

Thus, when the frame 16 supporting the jack assemblies 12, 14 is not extended straight, but bent slightly irregularly in the lateral or longitudinal direction, the respective jack assemblies during movement can swing as a whole with respect to the reacting support 20 thus said reacting shaft wall. Thereby, damages of the device caused by said irregularity can be prevented and the propulsion of the pipe can be maintained. Also, by applying said connecting portion, compared with a ball joint used in place of that, the shorter axial length of the jack will do, working and mounting are easily carried out and further the number of parts is reduced.

What is claimed is:

1. A pipe propelling device of the type, in which a pipe is propelled from a vertical shaft having a reacting shaft wall, comprising two sets of jack assemblies supported spaced from each other in said vertical shaft and extending laterally of said vertical shaft, each said jack assembly set comprising:

a plurality of first stage jacks having rod ends connected to said reacting shaft wall, and at least one second stage jack having a cylinder connected to each of the first stage jack cylinders and the rod end directed forward in the direction of propelling said pipe, the rearward end of said second stage jack cylinder being located nearer to the reacting shaft wall than the rearward end of said first stage jack rod when all said jacks are contracted.

2. A pipe propelling device of the type in which a pipe is propelled from a vertical shaft having a reacting shaft wall comprising two sets of jack assemblies supported spaced from each other in said vertical shaft and extending laterally of the vertical shaft, each said jack assembly set comprising:

a plurality of first stage jacks having rod ends connected to said reacting shaft wall, at least one second stage jack having a cylinder connected to each of the first stage jack cylinders and the rod ends directed forward in the direction of propelling said pipe, and a push ring connected to the second stage jack through a connecting portion such that said push ring is allowed to pivot with respect to the second stage jack, wherein said connecting portion comprises a socket provided in said push ring and a member received in said socket and fixed to a reduced diameter portion of said second stage jack rod end having the outer diameter converging forward in said propelling direction to prevent said reduced diameter portion from slipping out of said socket.

3. A pipe propelling device of the type in which a pipe is propelled from a vertical shaft having a reacting shaft wall comprising two sets of jack assemblies supported spaced from each other in said vertical shaft and extending laterally of the vertical shaft, each said jack assembly set comprising:

a plurality of first stage jacks having rod ends connected to said reacting shaft wall, at least one second stage jack having a cylinder connected to each of the first stage jack cylinders and the rod end directed forward in the direction of propelling said pipe, and a push ring connected to the second stage jack through a connecting portion such that said push ring is allowed to pivot with respect to the second stage jack, wherein said connecting portion comprises a socket provided in said push ring and having the inner diameter converging forward in said propelling direction and a member fixed to said second stage jack rod end received in said socket to prevent said rod end from slipping out of said socket.

4. A pipe propelling device as claimed in claim 1 wherein the plurality of first stage jacks comprise two first stage jacks arranged in parallel vertically, spaced from one another, wherein the second stage jack is disposed therebetween and wherein the device further comprises a connecting means connecting the cylinders of the jacks, the jacks being adapted so that in an extended position the second stage jack end extends forwardly of the first stage jack ends to propel a pipe.

* * * * *